United States Patent [19]

Stock et al.

[11] 4,371,201

[45] Feb. 1, 1983

[54] REVERSING RATCHET DOOR CLOSER

[75] Inventors: Arthur J. Stock, Lakewood; Donald S. Christopher, Willowick, both of Ohio

[73] Assignee: Stock Equipment Company, Cleveland, Ohio

[21] Appl. No.: 190,962

[22] Filed: Sep. 26, 1980

[51] Int. Cl.[3] ..... E05C 5/04

[52] U.S. Cl. ..... 292/251; 292/336.3

[58] Field of Search ..... 292/251, 336.3; 81/62, 81/63

[56] References Cited

U.S. PATENT DOCUMENTS

| | | | |
|---|---|---|---|
| 2,103,291 | 12/1937 | Lambert et al. | 292/251 X |
| 2,943,523 | 7/1960 | Gray et al. | 81/62 X |
| 3,089,330 | 5/1963 | Kerr | 292/251 X |
| 4,254,675 | 3/1981 | Marlow et al. | 81/63 |

*Primary Examiner*—Richard E. Moore

*Attorney, Agent, or Firm*—Pearne, Gordon, Sessions, McCoy & Granger

[57] ABSTRACT

A reversing ratchet lever assembly for driving a bolt or other threaded element to be turned selectively in clockwise and counterclockwise directions about a lever axis. The assembly has a housing that defines a bore coaxial with the lever axis and that receives a drive head for the bolt or other fastener. The drive head has radial external ratchet teeth that are adapted to be engaged by a double pawl pivotally mounted in the housing. The pawl is adapted for movement between forward drive and reverse drive engagement with the ratchet teeth and has an intermediate disengaged position. The assembly is operated by a lever handle adapted to be grasped by an operator. The handle has an inner end received in and retained in the housing for pivotal movement about a longitudinal twist axis located perpendicular to the lever axis. The inner end of the lever handle is operatively associated with the pawl and is adapted to move the pawl to its forward drive position when the handle is twisted in one direction and to its reverse drive position when the handle is twisted in the opposite direction. The handle is biased to a neutral position so that the pawl is disengaged unless the handle is positively twisted in one direction or the other.

5 Claims, 9 Drawing Figures

REVERSING RATCHET DOOR CLOSER

BACKGROUND OF THE INVENTION

This invention relates to ratchet-and-pawl type drive mechanisms such as used for tightening down and loosening threaded fasteners. More particularly, the invention relates to a fastening means with self-contained reversing ratchet drive that is particularly useful for securing doors, and especially doors that must be tightly secured to protect against unintentional release or against pressure or dangerous atmosphere on the other side. Although the invention is particularly adapted for use in securing doors on coal feeders such as those used in power plants, it is by no means limited to that application and has utility in the broad field of reversing ratchet drives.

In many coal-fired power plants, coal is stored in and supplied from overhead hoppers or bunkers and fed downwardly by gravity through feed control means to pulverizers, boiler stokers, cyclone burners, or other apparatus. The feed control means may be a gravimetric feeder that receives coal from the hopper and delivers the coal at a controlled rate as free-falling or separately flowing particles. A feeder adapted for this purpose, known as a gravimetric feeder, is described in U.S. Pat. No. 3,187,944, the disclosure of which is incorporated by reference herein and made a part hereof.

Typically, a gravimetric feeder has a small, positive pressure maintained therein and has heavy doors at each end that are tightly bolted shut with as many as eight separate fastening bolts. Because of the danger of explosion due to the coal dust entrained in the atmosphere within the feeder, the doors must be strong and be well-secured to the feeder housing.

While doors to such feeders have in the past been sufficiently strong and designed to be adequately secured to resist an explosion, workmen, after opening a door for access to the interior, frequently fail to secure all the bolts, and even occasionally only tighten down a few bolts just enough to keep the door in place. This presents a dangerous condition, since in the event of an explosion the door could blow off and injure nearby personnel.

The present invention greatly simplifies the procedure for securing the door and reduces the tendency of workers to fail to tighten down the bolts to the desired position. Also, the invention affords other features and advantages heretofore not obtainable.

SUMMARY OF THE INVENTION

It is among the objects of the invention to simplify the procedure for securing access doors on coal feeders and other industrial equipment.

Another object is to reduce the inconvenience of removing anchor bolts and retightening them with hand tools each time an industrial door or the like is to be opened and closed.

Still another object is to simplify the procedure for securing industrial doors that must be tightly secured to resist explosions or other dangerous conditions.

A further object of the invention is to provide a reversing ratchet lever assembly which requires special gripping in a positive manner in order to provide pawl engagement, and in which the lever is biased to a neutral position which holds the pawl out of engagement with the ratchet teeth so that if the lever assembly is positioned for operation about a horizontal axis, the handle will fall by its own weight to a pendular position when released.

These and other objects are achieved by the unique reversing ratchet lever construction of the invention, which is adapted to turn a bolt or other threaded element selectively in clockwise or counterclockwise direction about the pivotal axis of a lever, preferably a horizontal axis. The assembly has a housing that defines a bore coaxial with the lever axis and that receives a drive head for the fastener. The drive head has radial, external ratchet teeth that are adapted to be engaged by a double pawl pivotally mounted in the housing. The pawl is adapted for movement between forward drive and reverse drive engagement with the ratchet teeth and has an intermediate disengaged position. The assembly is operated by a lever handle adapted to be grasped by an operator. The lever has an inner end received in and retained in the housing for rotational movement about a longitudinal twist axis located perpendicular to the lever axis. The inner end of the lever handle is operatively associated with the pawl, and is adapted to move the pawl to its forward drive position when the handle is twisted in one direction and to its reverse drive position when the handle is twisted in the opposite direction. The handle is biased to a neutral position so that the pawl is disengaged unless the handle is positively twisted in one direction or the other.

DESCRIPTION OF THE PREFERRED EMBODIMENT

Figure 1:
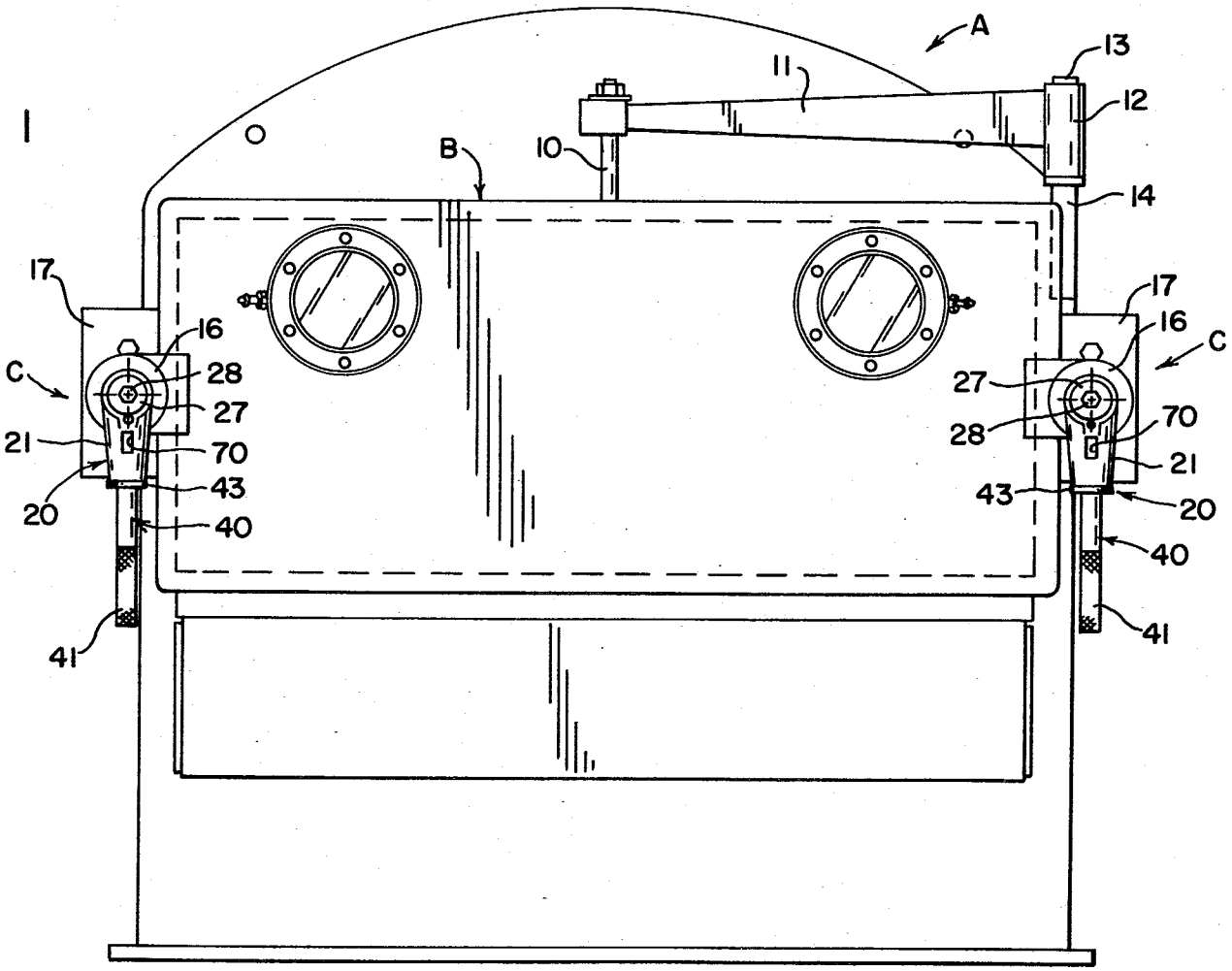
FIG. 1 is an end elevation of a gravimetric coal feeder with an access door secured in position by means of bolts turned by reversing ratchet lever assemblies embodying the invention.
Figure 2:
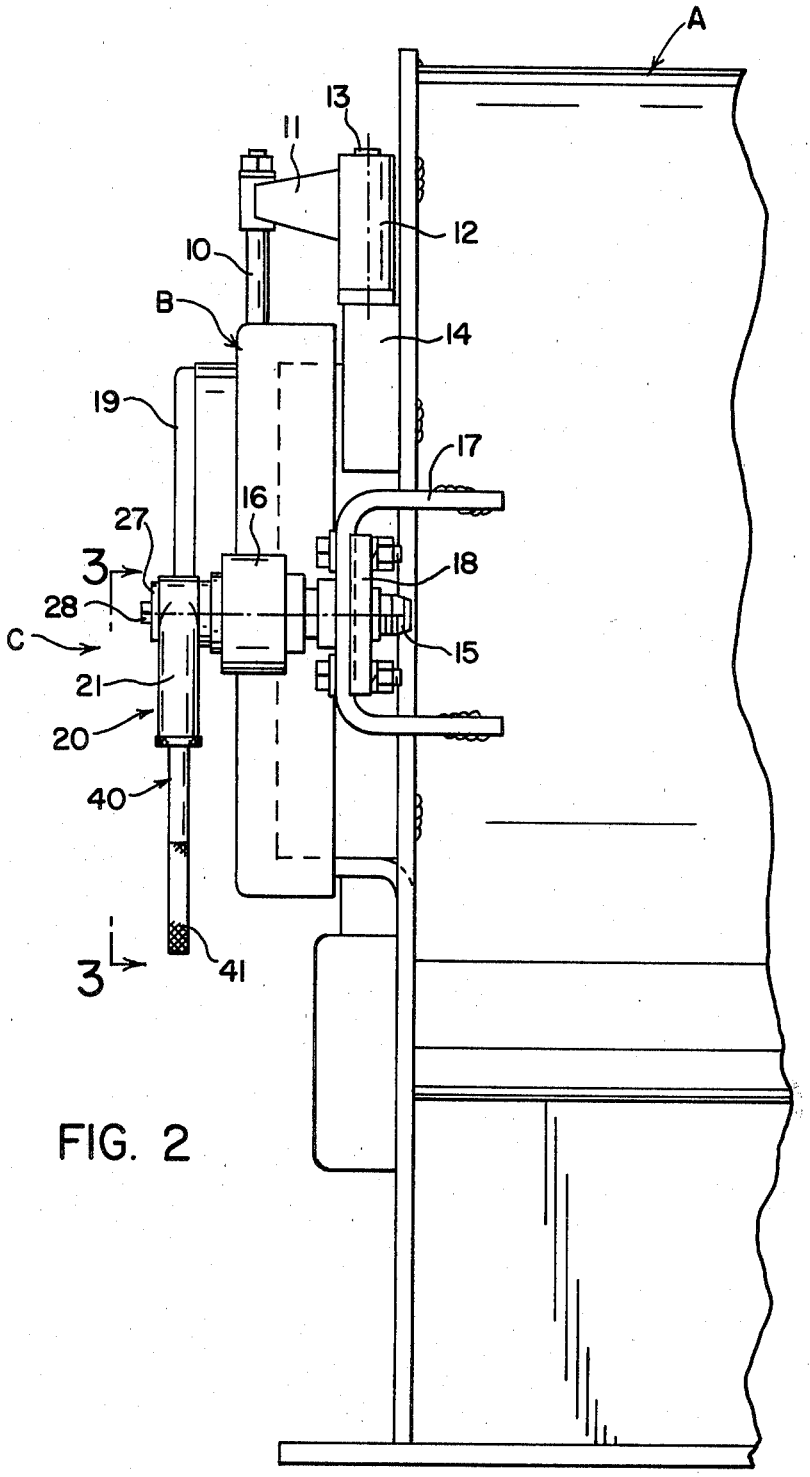
FIG. 2 is a fragmentary, side elevation on an enlarged scale, showing the access door and a reversing ratchet lever assembly of the type shown in FIG. 1.
Figure 3:
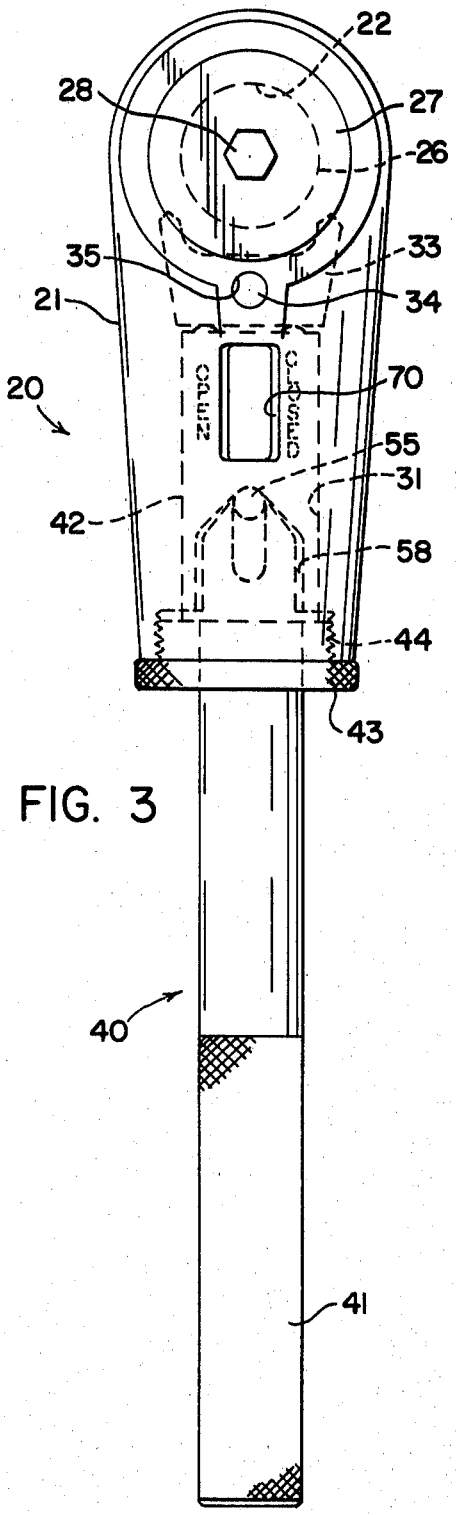
FIG. 3 is a front elevation on an enlarged scale, taken from the line 3—3 of FIG. 2 and illustrating one of the reversing ratchet lever assemblies used to secure the coal feeder door.

Referring more particularly to the drawings, and initially to FIGS. 1 and 2, there is shown the exterior of a gravimetric coal feeder of the type used in coal-fired power plants and similar to the type shown in U.S. Pat. No. 3,187,944 referred to above. The coal feeder has a housing A provided with a door B of new and improved design which is secured to the body of the feeder by means of two bolt-and-ratchet-drive assemblies C located on opposite ends of the door.

The door B, when opened, is adapted to be swung free of the opening to the feeder to permit access to the interior of the housing by workmen for the purpose of repair and service to the coal feeder mechanism disposed within the housing. The door B is supported when in its open position by means of a central carrier rod 10 that is connected from above to approximately the center of the top of the door. The rod 10 is pivotally supported by a swing arm 11 that is hinged at the right hand side of the coal feeder as viewed in FIG. 1. The swing arm 11 has a hinge sleeve 12 at its right-hand end that is pivotally supported on a vertical hinge pin 13 mounted on a hinge bracket 14 on the feeder housing.

A pair of inspection ports are provided in the door as shown to permit observation of the operation of the coal feeder mechanism inside.

As indicated above, it is important that the door B be tightly anchored to the housing in view of the explosive nature of the coal particle-laden atmosphere within the feeder A so that in the event of explosion, the door will not be blown off. In the past, as many as eight bolts have been used to lock the door in place (see, e.g., U.S. Pat. No. 3,187,944); however, in accordance with the present design, only two bolts 15 are used, the bolts being sufficiently large to provide the necessary strength. The bolts 15 are retained by and journaled in bearing assemblies 16 welded to opposite ends of the door B.

A pair of fastening brackets 17 are located on the opposite sides of the housing for the feeder A and have secured thereto large nuts 18, each of which receives ones of the bolts 15. The bolts 15 are operated by reversing-ratchet lever assemblies 20.

The assemblies 20 are best shown in FIGS. 3 through 9, and are identical, so that the description thereof will be limited to only the one on the right-hand side as viewed in FIG. 1. The assemblies 20 include a cast housing 21 of elongated form with a lateral bore 22 and counterbore 23 formed therein. The counterbore 23 is adapted to receive the head 24 of the bolt 15. The bolt head 24 is of reduced diameter and has radial grooves formed therein that define radial teeth 25 therebetween. The head 24 has an axial extension 26 which extends into the bore 22.

The bolt 15 is secured to the housing 21 by means of an annular retainer plate 27, which bears against the housing adjacent the bore 22 and which is secured to the head extension 26 by a machine screw 28 that is received in an axial threaded hole 29 in the head extension.

The housing 21 also has a longitudinal bore 31 formed therein that terminates at its inner end in a circular slot 32 that communicates with the lateral counterbore 23. The axis of the circular slot 32 is parallel to the axis of the bore 22 and counterbore 23, but spaced therefrom. The diameter of the slot 32 is slightly larger than the diameter of the counterbore 23.

A double pawl 33 is pivotally mounted within the slot 32 on a pawl pin 34 that extends laterally through the housing. The ends of the pin 34 are seated in a lateral bore 35 on opposite sides of the slot 32. The pawl 33 is adapted for pivotal movement about an axis parallel to the axes of the counterbore 23 and slot 32, but spaced slightly below the axis of the slot 32. The pawl 33 is adapted for movement to a forward drive position wherein it engages the teeth of the bolt head 24 for turning the bolt 15 in a clockwise direction (tightening) and a reverse drive position (FIG. 7), wherein it engages the teeth for rotation in a counterclockwise direction in order to release the bolt 15. The pawl 33, how ever, is biased to an intermediate position shown i FIGS. 3, 4 and 6.

The reversing-ratchet lever assembly 20 is operatec by a pivotable handle assembly 40 that has a grip por tion 41 at its outer end and that has an inner end 42 o slightly larger diameter received in the bore 31. Th handle assembly 40 is secured to the housing 21 b means of a retainer cap 43 with a threaded boss 44 tha is received in a threaded counterbore 45 at the lowe end of the housing 21. The upper face of the boss 4 bears against the shoulder that is formed between th main body of the handle 40 and the enlarged inner enc 42.

Figure 4:
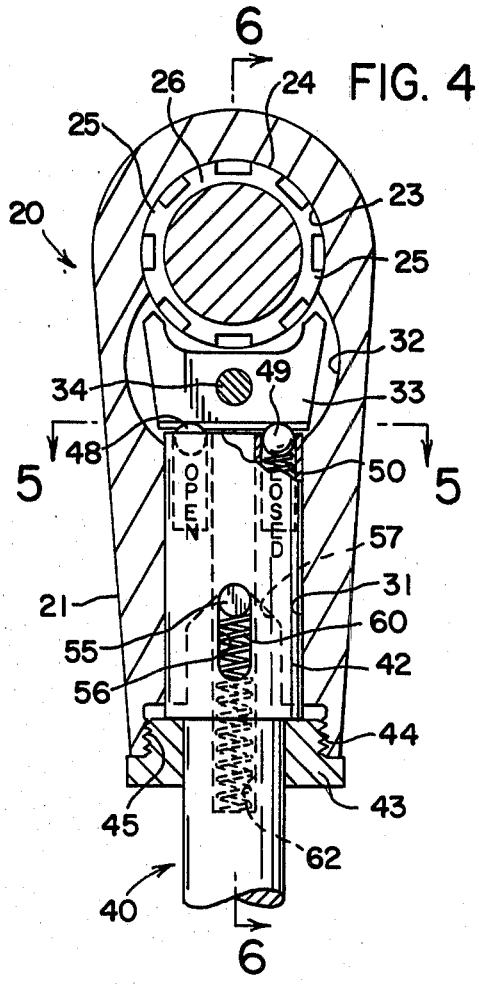
FIG. 4 is a fragmentary, sectional view of the reversing ratchet lever assembly of FIG. 3.
Figure 5:
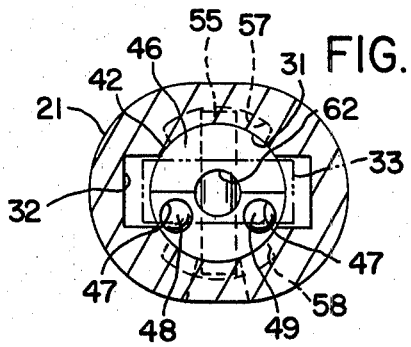
FIG. 5 is a sectional view taken on the line 5—5 of FIG. 4.
Figure 6:
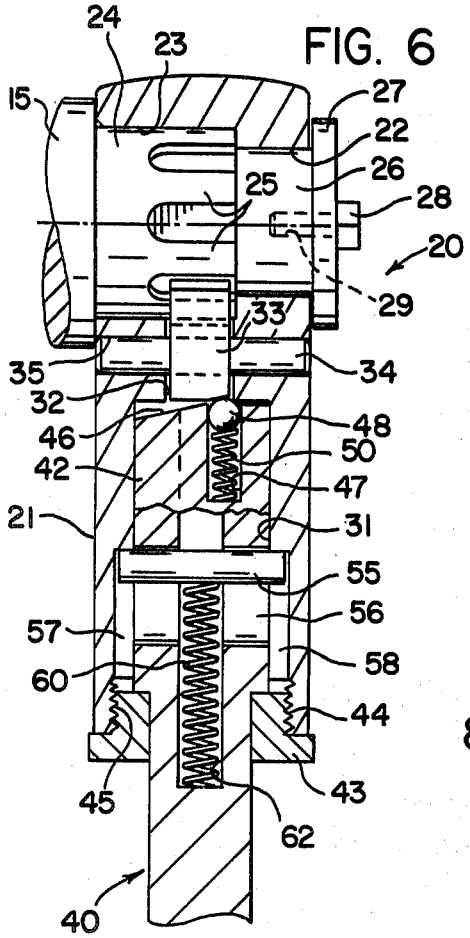
FIG. 6 is a fragmentary, sectional view taken on the line 6—6 of FIG. 4.
Figure 9:
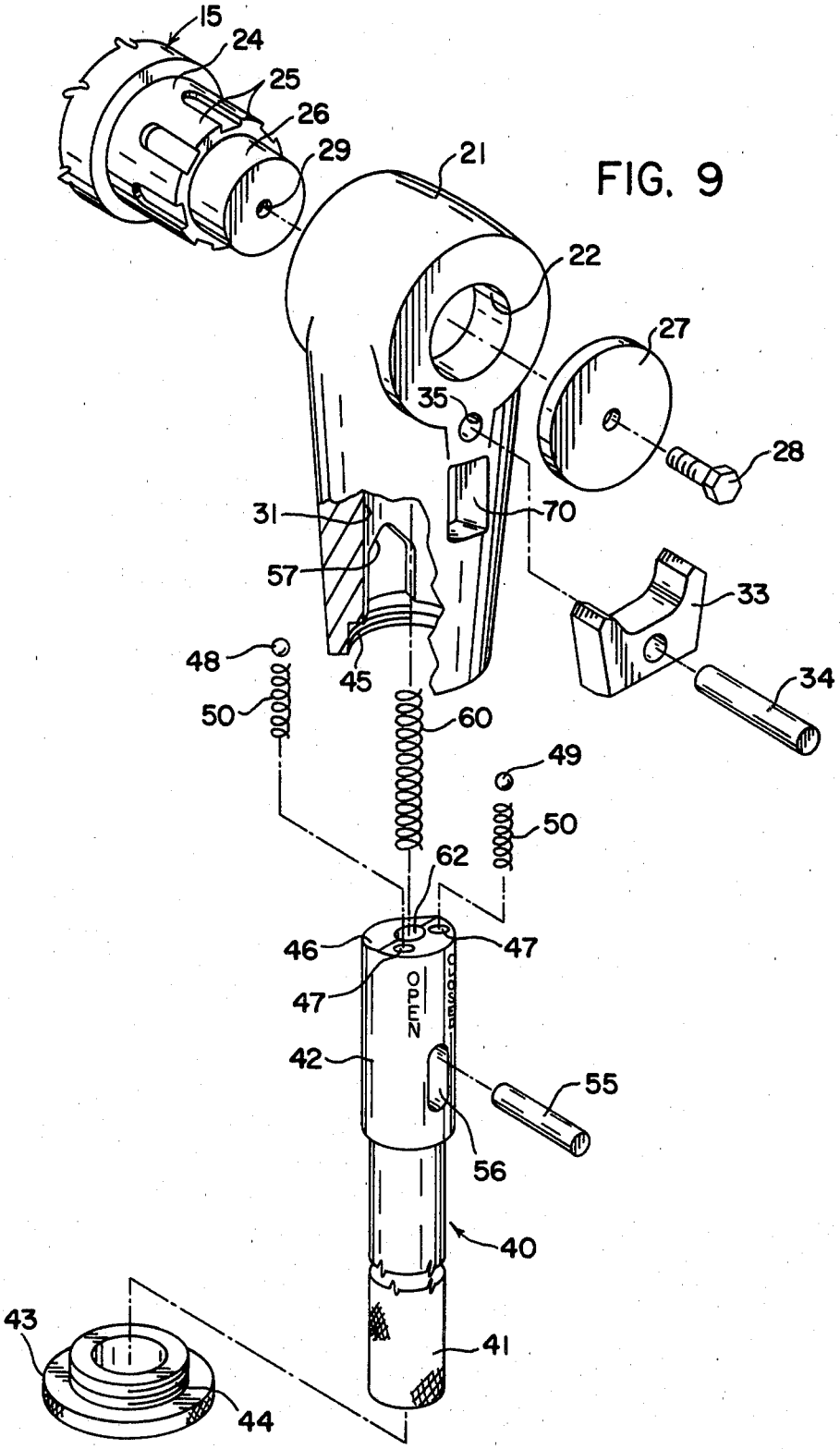
FIG. 9 is an exploded, perspective view of the reversing ratchet lever assembly illustrating the manner in which the respective parts are assembled.

The circular inner end face of the inner end 42 has ar angular cut to provide a sloping ramp portion 46 acros about half of the end face (FIGS. 5, 6 and 9). Twc longitudinal bores 47 are formed in the opposite fla portion of the end face each of which receives one of a pair of steel balls 48 and 49 which are urged upwardl by springs 50. The balls 48 and 49 engage the bottom o the double pawl 33 so that when the handle assembly 4 is in a neutral position, both balls bear with equal forc against the pawl and keep the pawl in an intermediate neutral position (FIGS. 3, 4, 5 and 6) wherein the pawl is entirely disengaged from the ratchet teeth 25 of the bolt head 22.

Figure 7:
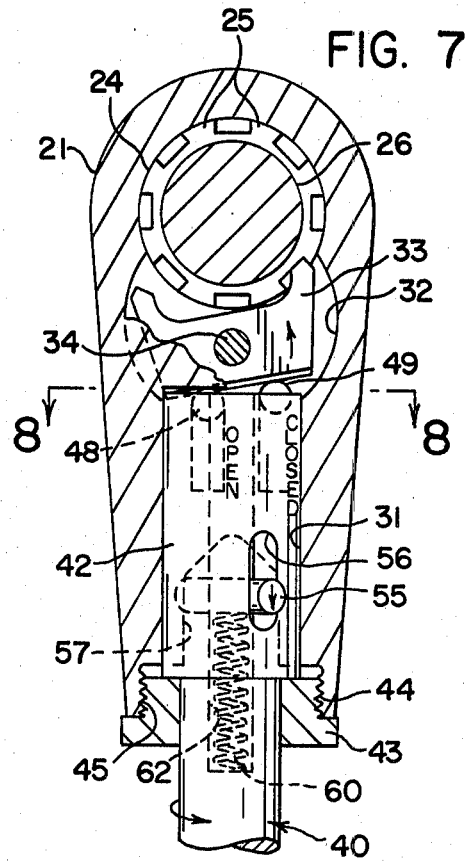
FIG. 7 is a fragmentary, sectional view similar to FIG. 4, showing the pawl moved by the lever handle to its reverse drive position.
Figure 8:
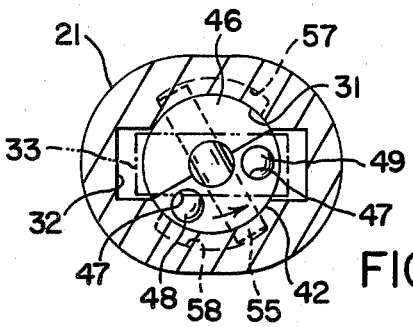
FIG. 8 is a sectional view taken on the line 8—8 of FIG. 7.

When the handle assembly 40 is pivoted, such as in the direction illustrated by the arrow in FIGS. 7 and 8, the ball 48 moves downward to a retracted position while depressing the respective spring 50 and the ball 49 extends upward to move the pawl 33 into reverse drive engagement with the ratchet teeth 25. When the handle assembly 40 is held twisted to this position, ratcheting movement of the lever assembly 20 can be accomplished to unscrew the bolt 15 from the nut 18.

When the handle assembly 40 is pivoted in the opposite direction from that shown by the arrow in FIG. 7, the balls 48 and 49 reverse their positions relative to one another so that the pawl 33 is moved to forward drive engagement with the ratchet teeth 25 and operation of the lever assembly 20 will, by ratcheting motion, tighten the bolt 15 in the nut 18.

It is desirable, when the ratchet lever assembly 20 is not being used to operate the bolt 15, that the pawl 33 be disengaged from the ratchet teeth 25 as shown in FIGS. 3, 4, 5 and 6 and that the lever assembly drop to a pendular position illustrated in FIGS. 1 and 2, where it hangs free. In order to do this, the handle assembly 40 must be biased to its neutral position, as illustrated in FIG. 4. This is accomplished by means of a transverse pin 55 that extends through an elongated lateral slot 56 cut in the inner end 42 of the handle assembly 40 and which has its opposite ends extending outwardly from the cylindrical inner end 42 into recesses 57 and 58 located on opposite sides of the bore 31. The recesses have their upper portions sloping so as to converge at a high point and provide camming faces on either side. The pin 55 is biased to an upward position in the slot 56 by means of a helical spring 60, mounted below the pin 55 in a longitudinal bore 62 drilled through the end of the inner end 42, as best shown in FIGS. 4 and 6.

Whenever the handle assembly 40 is twisted in one direction or the other, the pin 55 is forced downwardly against the spring 62 due to its engagement with the camming surfaces of the recesses 57 and 58. Then, when the handle assembly 40 is released, the spring 60 urges the pin 55 upwardly, which in turn twists the handle about its longitudinal axis to the neutral position wherein the balls 48 and 49 each engage the bottom surface of the pawl 33, as illustrated in FIGS. 4, 5, and 6. It is thus apparent that an operator must positively twist the handle assembly 40 in one direction or another and hold the handle assembly in that twisted position in order to obtain proper pawl engagement for ratcheting the bolt 15 to an open or closed position.

In order that the operator may have a visual indication of the ratcheting condition selected by a particular twisting movement of the handle assembly 40, an opening 70 (FIGS. 3 and 9) is cut in the housing 21 to permit viewing of the surface of the inner end 42. The words "open" and "closed" are etched in the face of the inner end in such a way that "open" appears in the opening 70 when the handle assembly is pivoted to the position shown in FIG. 7, and the word "closed" appears in the opening when the handle assembly is twisted in the opposite direction.

With this construction, the operating mechanism for the bolt 15 is directly associated with the bolt itself, and the ratcheting action greatly simplifies the procedure for tightening and loosening the bolt for opening and closing the door B. As an additional advantage, the ratchet lever assembly 20 is biased to a neutral position so that the handle assembly when released will fall to a pendular position shown in FIGS. 1 and 2 without any effort on the part of the operator.

Overall, the device of the invention greatly reduces the natural inclination of an operator to ignore or intentionally fail to observe proper procedures for securing the door in place once it has been opened.

While the invention has been shown and described with respect to a specific embodiment thereof, this is for the purpose of illustration rather than limitation and other variations and modifications of the particular device herein shown and described will be apparent to those skilled in the art all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. A reversing ratchet drive for turning a fastener selectively in clockwise and counterclockwise directions about a lever axis, comprising:

a lever supported for pivotal movement about said axis;

a housing defining a bore coaxial with said lever axis;

a drive head integral with said fastener received within said bore and having radial external ratchet teeth;

a double pawl pivotally mounted in said housing for movement between forward drive and reverse drive engagement with said external ratchet teeth and having an intermediate disengaged position;

said lever comprising a handle assembly having an inner end received in said housing for turning movement therein about a twist axis perpendicular to said lever axis, said handle assembly being adapted to turn said housing about said lever axis;

means carried by said inner end of said handle assembly for moving said double pawl to its forward drive position when said handle assembly is twisted about its twist axis in one direction and to its reverse drive position when said handle assembly is turned about its twist axis in the opposite direction; and means for biasing said handle to a neutral position between said two directions of twist wherein said pawl is in said disengaged position.

2. A lever assembly as defined in claim 1, wherein said means for moving said double pawl to its forward drive position and to its reverse drive position when said handle is twisted comprises a pair of pawl-engaging means carried at the end of said inner end of said handle assembly and spaced from one another on opposite sides of said twist axis, said pawl-engaging means being located at one side of said pawl when said pawl is in its neutral position and being adapted to positively hold said pawl in said neutral position and whereby twisting movement of said handle assembly moves one of said pawl-engaging means against the bottom surface of one side of said pawl and moves the other pawl-engaging means away from said pawl to move said pawl into one of its ratchet teeth-engaging positions.

3. A lever assembly as defined in claim 2, wherein said pawl-engaging means comprises a pair of balls mounted in recesses in said inner end of said handle assembly and being spring-loaded toward engagement with said double pawl.

4. A lever assembly as defined in claim 1, including means for biasing said handle assembly to a neutral position intermediate said two directions of twist wherein said pawl is in said disengaged position.

5. A lever assembly as defined in claim 4, wherein said means for biasing said handle assembly to said neutral position comprises a transverse pin slidably mounted in said inner end for movement in a direction parallel to said twist axis, a helical spring biasing said pin in an upward direction and means defining opposed camming surfaces in said housing that receives the laterally extending ends of said pin, said camming surfaces being formed to permit maximum upward movement of said pin when said handle assembly is in its intermediate position whereby said handle assembly returns to its intermediate position when released from a twisted position.

* * * * *